US006357810B1

(12) United States Patent
Schwulst

(10) Patent No.: US 6,357,810 B1
(45) Date of Patent: Mar. 19, 2002

(54) HOIST ASSEMBLY

(75) Inventor: Kyle E. Schwulst, Audobon, PA (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/478,286

(22) Filed: Jan. 14, 2000

(51) Int. Cl.[7] ..... B66C 1/14
(52) U.S. Cl. ..... 294/81.3; 294/81.56; 294/67.5
(58) Field of Search ..... 294/67.21, 67.3, 294/67.4, 67.5, 68.3, 81.1, 81.3, 81.5, 81.55, 81.56

(56) References Cited

U.S. PATENT DOCUMENTS 1,862,081 A * 6/1932 Grant ..... 294/67.21
2,514,307 A * 7/1950 Boyd ..... 294/67.21
2,984,513 A * 5/1961 Nearman ..... 294/67.22
3,146,016 A * 8/1964 Daymon, Jr. ..... 294/81.3
3,191,983 A * 6/1965 Gaglione ..... 294/81.3
3,502,364 A * 3/1970 Moore ..... 294/81.21
3,675,960 A * 7/1972 Mangold ..... 294/81.3
4,973,094 A * 11/1990 Tana et al. ..... 294/81.3
6,048,012 A * 4/2000 Selby et al. ..... 294/67.5

FOREIGN PATENT DOCUMENTS

SU 992-383 * 2/1983 ..... 294/67.5

* cited by examiner

*Primary Examiner*—Dean J. Kramer

(57) ABSTRACT

A hoist assembly 10 for lifting an object 12 includes a support fixture 14 having three elongated support rails or members 16, 18, and 20, a movable lever assembly 24, which is mounted upon a spanning member 22, and three interconnecting chains, members or assemblies 26, 28, and 30 which are coupled to fixture 14 and to object 12. Movable lever assembly 24 moves from a first position to a second position when object 12 is lifted, thereby shifting the center of gravity 142 of the fixture 14 and allowing fixture 14 and object 12 to remain in a level or horizontal position.

17 Claims, 4 Drawing Sheets

HOIST ASSEMBLY

FIELD OF THE INVENTION

The present invention generally relates to a hoist assembly and more particularly, to a hoist assembly including a movable member which selectively and automatically shifts the center of gravity of the hoist assembly, thereby allowing the hoist assembly to remain in a substantially level position when it is loaded and unloaded.

BACKGROUND OF THE INVENTION

Hoist assemblies are generally used to lift, elevate, and/or move relatively heavy and/or cumbersome components, devices, and/or other objects. Hoist assemblies typically include several members which are interconnected to cooperatively form a frame or support fixture, and one or more chains, cables, or other connecting members which are selectively attached to the support fixture and to the device or object that is desired to be lifted. The support fixture is coupled to a motor, winch, or other lifting assembly or apparatus which selectively lifts or elevates the fixture and the object or device which is attached to the fixture. These types of fixtures are typically designed to allow the lifted object or device to remain substantially level (e.g., horizontal) while it is being lifted and/or moved, thereby preventing movable components or movable portions of the object or device from being undesirably moved or displaced while the object is being lifted.

One of the major drawbacks associated with these prior hoist assemblies is that the process of loading and/or unloading devices and other objects to/from these prior hoist assemblies is undesirably time-consuming, difficult, and cannot typically be performed by a single person or operator. For example and without limitation, when used to lift an object which has an "off-centered" center of gravity (e.g., a center of gravity which is located remote from the center of symmetry of the object), the support fixture which is used is typically manufactured or formed to be disproportionately or unevenly "weighted" in order to compensate for the "off-centered" center of gravity of the object, thereby ensuring that the object and fixture remain in a level position when the object or device is lifted. This disproportionate or uneven "weighting" causes the fixture to undesirably reside in an "unleveled" or sloped position when it is not "loaded" (i.e., when the object is not attached to the fixture), and therefore requires the fixture to be "leveled" prior to attaching the object or device to the fixture. Hence, in order to secure and/or remove items to/from these prior hoist assemblies, one individual or operator is required to hold the relatively heavy and cumbersome fixture in a substantially horizontal and/or level position, while another individual or operator connects the object or device to the fixture. Moreover, the relatively heavy weight of the fixture often causes the fixture to slip, drop, or pitch while it is being held, thereby potentially damaging the object or device which is being attached to the fixture.

There is therefore a need for a new and improved hoist assembly which overcomes many, if not all, of the previously delineated drawbacks of such prior hoist assemblies.

SUMMARY OF THE INVENTION

It is therefore a primary object of the invention to provide a hoist assembly which overcomes at least some, if not all, of the previously delineated disadvantages of prior hoist assemblies.

It is a second object of the invention to provide a hoist assembly which includes a support fixture which remains in a substantially level position when it is loaded and unloaded.

It is a third object of the invention to provide a hoist assembly which is further characterized by its ability to allow a single user or operator to relatively easily secure and/or attach an object to the hoist assembly.

It is a fourth object of the invention to provide a hoist assembly for lifting an object which includes a movable member that selectively and automatically shifts the center of gravity of the hoist assembly when the object is lifted, thereby causing the assembly and the object to remain in a substantially level position.

According to one aspect of the present invention, a hoist assembly for lifting an object is provided. The hoist assembly includes a plurality of interconnecting members which are selectively coupled to the object; and a fixture which is coupled to the interconnecting members and which is selectively suspended at a first location. The fixture has a movable member and a center of gravity, the center of gravity being aligned with the first location when the object is not being lifted, thereby allowing the fixture to be suspended in a substantially level position. The movable member is movable from a first position to a second position in response to the object being lifted, the movement being effective to cause the center of gravity to shift to a second location, the shift being effective to cause the fixture and the object to remain level while the object is being lifted.

According to a second aspect of the present invention, a method for lifting an object is provided. The method includes the steps of: providing a fixture having a movable member and a center or gravity; suspending the fixture from a point on the movable member which is substantially aligned with the center of gravity, thereby causing the fixture to remain in a substantially level position; coupling the object to the fixture; providing an upward force at the point, effective to lift the object and to cause the movable member to move, thereby shifting the center of gravity and causing the object to remain in a level position.

Further objects, features, and advantages of the present invention will become apparent from a consideration of the following description and the subjoined claims, when taken in conjunction with the accompanying drawings.

DETAILED DESCRIPTION OF THE PREFERRED EMBODIMENT OF THE INVENTION

Figure 1:
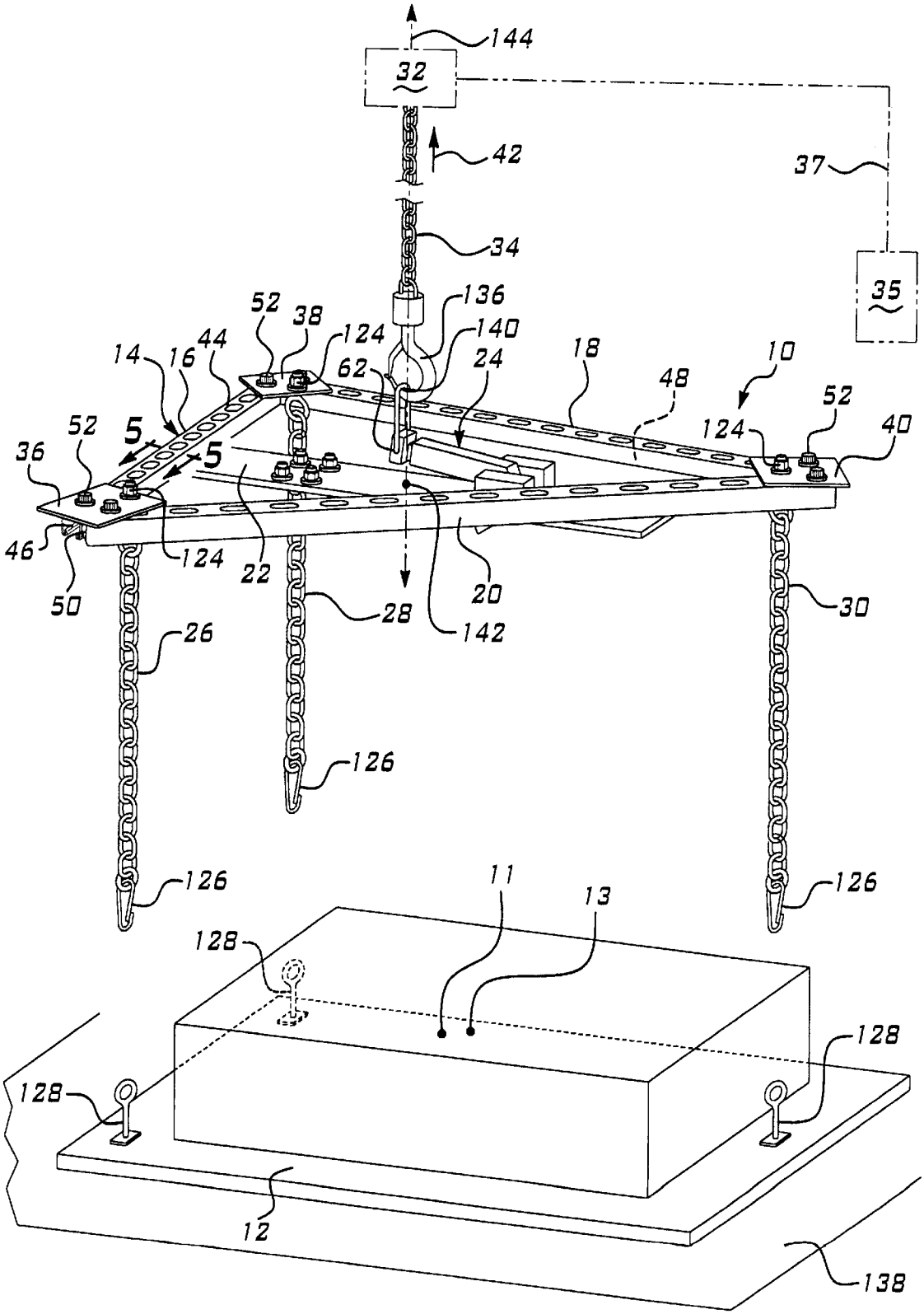
FIG. 1 is a perspective view of a hoist assembly which is made in accordance with the teachings of the preferred embodiment of the invention, and which is illustrated in an unloaded state.

Referring now to FIGS. 1–5, there is shown a hoist apparatus or assembly 10 which is made in accordance with the teachings of the preferred embodiment of the invention, and which is adapted to operatively lift an object 12 having an "off-centered" center of gravity 13 (e.g., a center of gravity which is located remote from the center of symmetry 11 of object 12). As shown, assembly 10 includes a support fixture 14 having three elongated support rails or members 16, 18, and 20, a movable lever assembly 24, which is mounted upon a spanning member 22, and three interconnecting chains, members or assemblies 26, 28, and 30 which are selectively coupled to fixture 14 and to object 12. Fixture 14 is removably coupled to a force-providing or lifting member or assembly 32 by use of an interconnecting chain, member or assembly 34. Assembly 32 selectively provides an upward force in the direction of arrow 42, which is effective to lift fixture 14 and object 12.

Elongated rail members 16, 18, and 20 are manufactured and/or formed from a relatively strong and durable conventional and commercially available material such as steel, aluminum or any other suitable material, and each include a plurality of substantially identical apertures 44. Members 16, 18, and 20 have substantially identical and generally "C"-shaped cross-sections that respectively form slots or channels 46, 48, and 50 which are substantially, respectively and longitudinally coextensive with rail members 16, 18, and 20.

In the preferred embodiment, members 16–20 cooperatively form a generally triangular frame or structure, and are fixedly coupled together by way of three substantially identical plate members 36, 38, and 40. Particularly, plate member 36 is fixedly coupled to members 16 and 20 by way of a pair of substantially identical and conventional bolt-type fasteners 52, each of which conventionally, respectively and operatively engage a unique one of apertures 44 formed within member 16 and member 20, thereby operatively connecting members 16 and 20. Plate member 38 is fixedly coupled to members 16 and 18 by way of a pair of fasteners 52, each of which conventionally, respectively and operatively engage a unique one of apertures 44 formed within members 16 and 18, thereby operatively connecting members 16 and 18. Plate member 40 is fixedly coupled to members 18 and 20 by way of a pair of fasteners 52, each of which conventionally, respectively and operatively engage a unique one of apertures 44 formed within members 18 and 20, thereby operatively connecting members 18 and 20.

In other alternate embodiments, plate members 36–40 are coupled to members 16–20 in other conventional manners such as by clamps, screws, adhesives, and/or any other suitable fastening devices or methods. In one non-limiting embodiment, members 16–20 are directly and physically coupled together in a conventional manner such as by welding, sintering, bonding or any other suitable manner or device.

Figure 5:
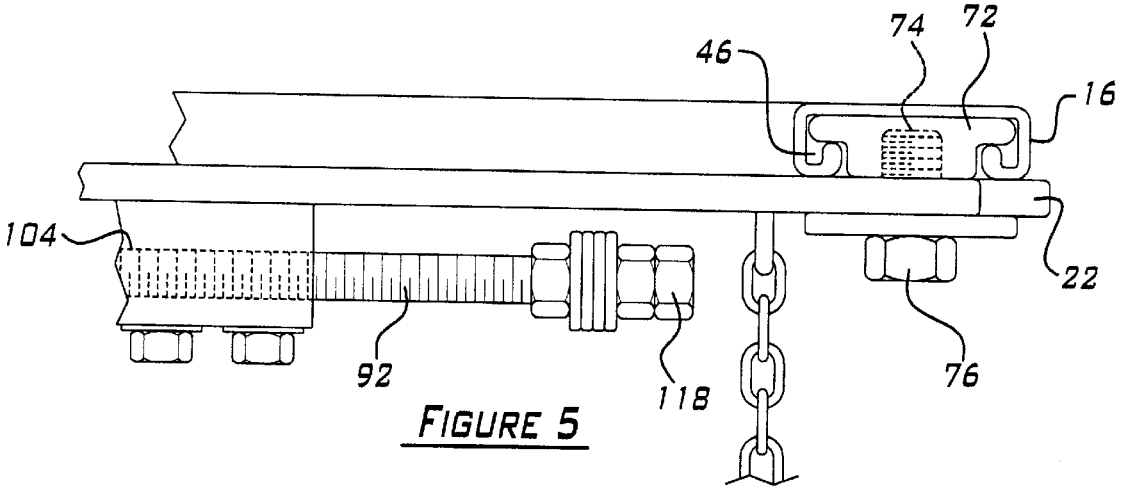
FIG. 5 is a partial cross sectional view of the hoist assembly shown in FIG. 1 and taken along view lines 5—5.

Spanning member 22 is removably and/or adjustably coupled to rails 16 and 20 in a conventional manner. In the preferred embodiment of the invention, as best shown in FIG. 5, spanning member 22 includes two substantially identical generally "T"-shaped clamping portions or members 72 which insertably, conformingly, and respectively reside within channel 46 of member 16 and within channel 50 of member 20. Each member 72 includes a centrally disposed and threaded aperture 74 which selectively and operatively receives a conventional bolt-type fastener 76, thereby selectively and clampingly securing spanning member 22 to rails 16 and 20. It should be appreciated that fasteners 76 may be loosened, effective to allow members 72 to slidably move within channels 46 and 50, thereby allowing the position of spanning member 22 to be selectively adjusted.

Figure 4:
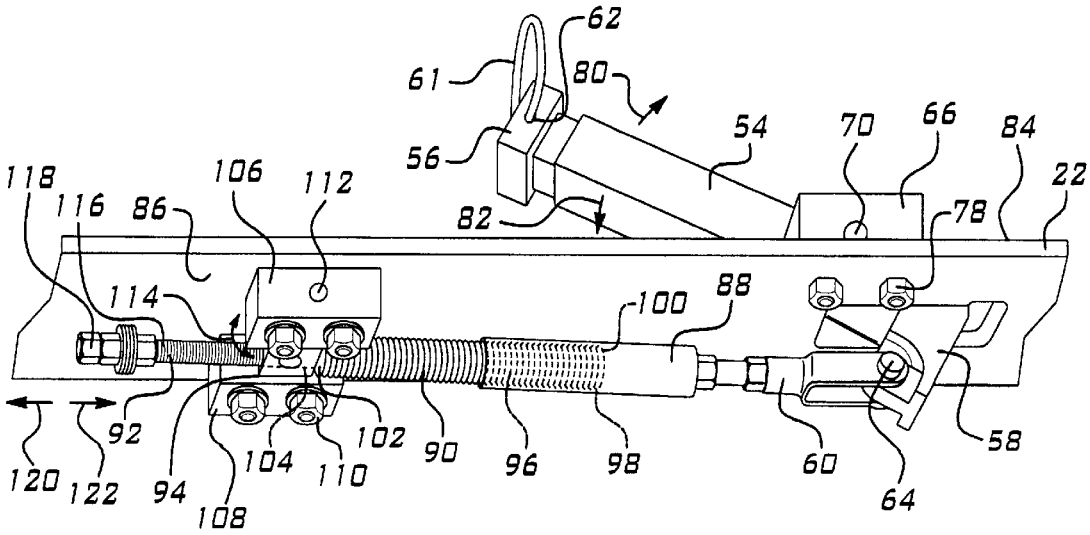
FIG. 4 is a partial bottom perspective view of the hoist assembly shown in FIG. 1.

As best shown in FIG. 4, movable lever assembly includes a generally "L"-shaped lever or arm member 54 and a movable rod member 60. Member 54 is conventionally and pivotally mounted to a pair of substantially identical and generally rectangular support members 66, 68 which are fixedly and conventionally mounted to the top surface 84 of spanning member 22 by use of conventional bolt-type fasteners 78. In the preferred embodiment of the invention, lever or arm member 54 is pivotally coupled to support members 66, 68 by way of a conventional pin, rod, or dowel member 70, thereby allowing member 54 to be pivotally movable in the directions illustrated by arrows 80 and 82. In the preferred embodiment of the invention, member 70 includes a bearing or bushing (not shown) which rotatably engages member 54.

Lever or arm member 54 includes an "upper" end 56, which is selectively coupled to interconnecting member 34, and a "lower" end 58, which is coupled to movable rod member 60. End 56 includes a generally oval-shaped linking or connecting member 61 which is pivotally and conventionally coupled to end 56 by way of a conventional rod, pin, or dowel member 62 and which selectively couples end 56 to member 34. End 58 of lever or arm member 54 is conventionally and pivotally coupled to rod member 60 by way of a conventional rod, pin, or dowel member 64.

Rod member 60 includes a generally cylindrical spring-engaging member or portion 88, which engages a selectively compressible and expandable spring member 90, and a narrow portion 92, which slidably engages a generally square support member 94. Portion 88 of rod 60 includes a channel 96 in which a portion of spring 90 operatively resides. Channel 96 terminates in an end 98, which abuttingly engages end 100 of spring 90.

In the preferred embodiment, spring 90 is a conventional and commercially available coil-type spring. In other alternate embodiments, spring 90 may comprise a gas spring or another type of spring device. Spring 90 is operatively disposed around portion 92 of rod 60, and includes a second end 102, which abuttingly engages member 94.

Member 94 includes a generally cylindrical shaped channel 104 within which portion 92 is slidably disposed. Member 94 is conventionally and pivotally coupled to a pair of substantially identical and generally rectangular support members 106, 108 that are fixedly and conventionally mounted to the bottom surface 86 of spanning member 22 by use of conventional bolt-type fasteners 110. In the preferred embodiment, member 94 is pivotally coupled to support members 106, 108 by way of a conventional pin, rod, or dowel member 112, and is pivotally movable in the directions which are illustrated by arrows 114. Portion 92 includes a threaded end portion 116 on which nuts or weighted members 118 may be selectively attached.

It should be appreciated that the movement of lever or arm member 54, in the direction of arrow 80, will cause spring 90 to be compressed and rod 60 to move in the direction illustrated by arrow 120. Furthermore, the movement of lever or arm member 54 in the direction of arrow 82 will cause spring 90 to expand and rod 60 to move in the direction illustrated by arrow 122.

In the preferred embodiment of the invention, interconnecting members or assemblies 26–30 comprise conventional chains. In other alternate embodiments, assemblies 26–30 may comprise cables, cords, ropes, or any other suitable interconnecting members or assemblies. Interconnecting assemblies 26, 28, and 30 are respectively coupled to plate members 36, 38, and 40 by way of conventional and substantially identical eyebolts 124. Assemblies 26–30 further include substantially identical conventional hook or "latch"-type fasteners or fastening members 126. In alternate embodiments, fasteners 126 may comprise a variety of other known attachment or fastening devices or apparatuses. Fasteners 126 are adapted to selectively and conventionally engage eyebolts 128, which are fixedly coupled to object 12.

Force-providing or lifting assembly 32 comprises a conventional winch, pulley system, crane, motor, or other assembly, which is effective to selectively pull and/or draw interconnecting member 34 in the direction of arrow 42, thereby lifting and/or elevating fixture 14 and object 12. In the preferred embodiment of the invention, assembly 32 includes a conventional remotely-operated, hand-held controller 35 which electrically and communicatively coupled to assembly 32 by way of a conventional communications cable or wire 37, and is effective to selectively activate, position, and/or move assembly 32 and member 34. A conventional hook or latch type member 136 selectively receives connecting member 61, thereby securing fixture 14 to assembly 32.

In operation, fixture 14 is coupled to assembly 32. Particularly, connecting member 61 is operatively inserted into and received by latch member 136. When connected to latch 136, fixture 14 is suspended in a substantially level or horizontal position (i.e., in a position substantially parallel to ground surface 138). This substantially level "suspension" of fixture 14 is achieved by suspending the fixture 14 from a point or location 140 which is substantially aligned with the center of gravity 142 of fixture 14. Particularly, location 140 and center of gravity 142 both substantially lie along a substantially vertical axis 144. The substantially level or horizontal suspension of fixture 14 allows a single user to operatively position the fixture 14 over object 12 by way of controller 35.

Figure 2:
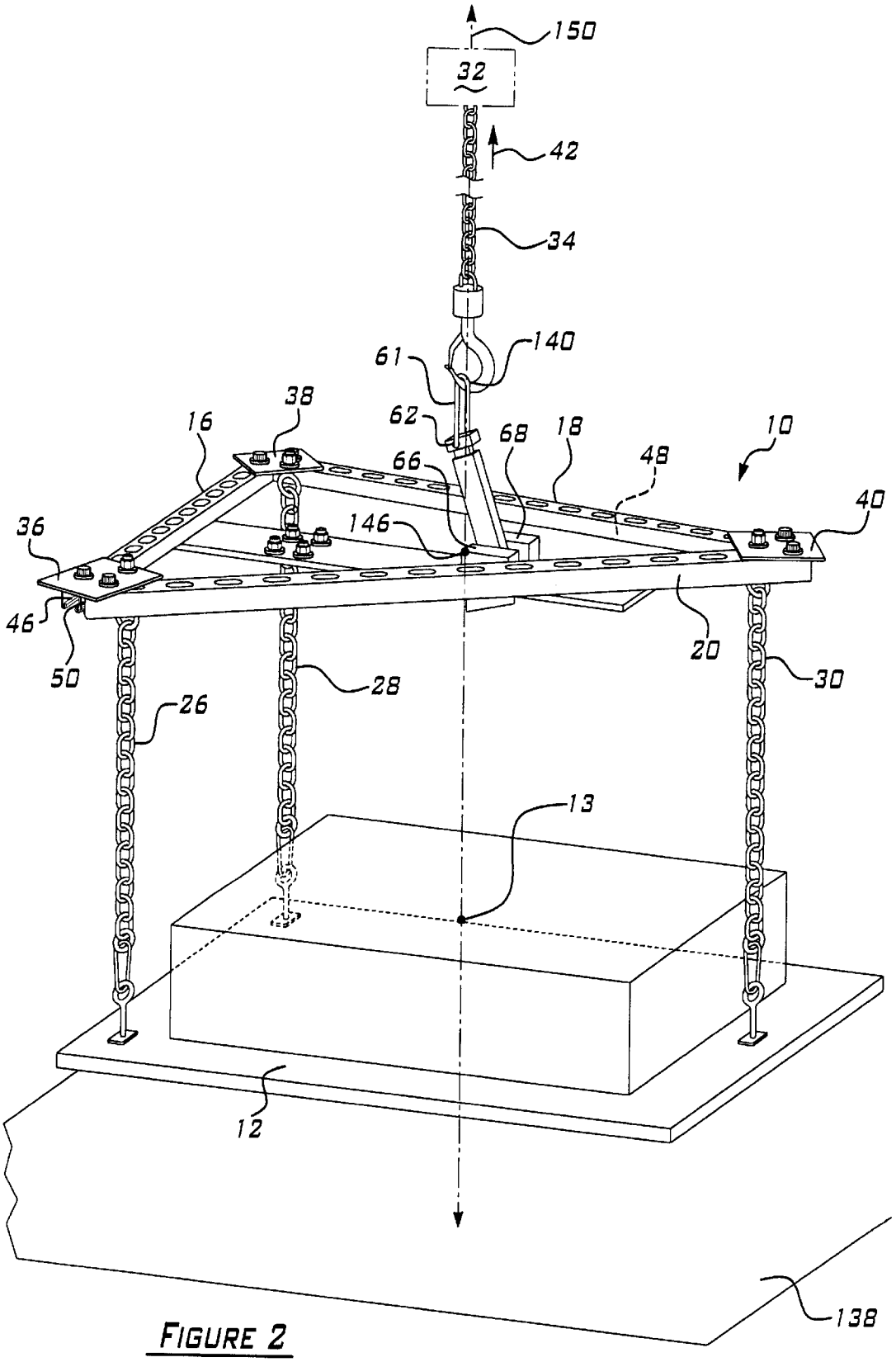
FIG. 2 is a perspective view of the hoist assembly which is shown in FIG. 1, and which is illustrated in a loaded state.
Figure 3:
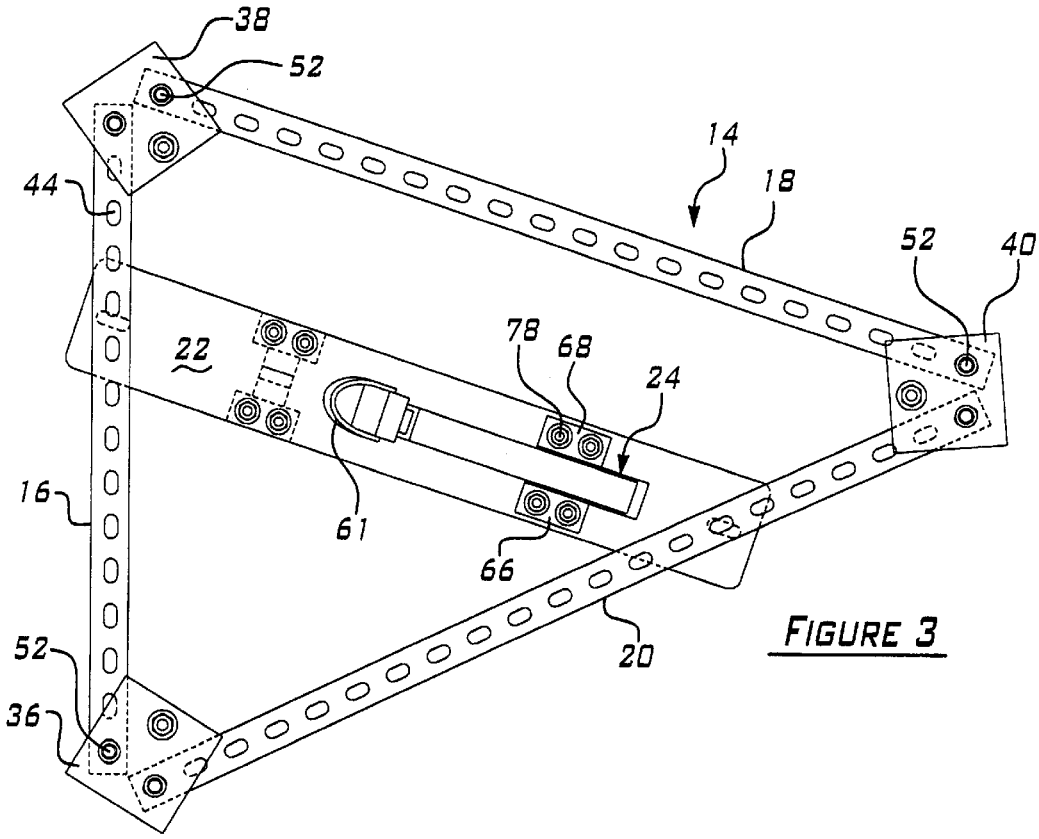
FIG. 3 is a top view of the hoist assembly shown in FIG. 1.

Once fixture 14 is substantially and operatively aligned with object 12, a user or operator lowers fixture 14 and attaches hook or latch members 126 to eyebolts 128, as shown in FIG. 2. Assembly 32 is then activated and provides a lifting or elevating force in the direction of arrow 42. This force is transferred to arm or lever member 54 by way of connector member 61, and cooperates with the weight of object 12 to cause member 54 to pivot in the direction illustrated by arrow 80. As member 54 pivotally moves in the direction of arrow 80, rod 60 moves in the direction of arrow 120, thereby compressing spring 90. Once the force required to further compress spring 90 exceeds the weight of object 12 and fixture 14, the object 12 is lifted or elevated from surface 138.

The movement and weight of arm or lever member 54 causes the center of gravity 142 of fixture 14 to move or shift to a new point or location 146 which is substantially aligned with the center of gravity 13 of object 12. Additionally, this shifting movement of lever member 54 further causes the point or location 140 at which the lifting force of assembly 32 is provided to become substantially aligned with the center of gravity 13 of object 12. Particularly, location 140, the new center of gravity 146 of fixture 14, and the center of gravity 13 of object 12 each substantially lie along a substantially vertical axis 150. It should be appreciated that in this manner, both object 12 and fixture 14 remain in a substantially level or horizontal position when object 12 is lifted (i.e., both object 12 and fixture 14 remain substantially parallel with respect to the ground surface 138). When object 12 is disconnected or removed from hoist assembly 10, arm or lever 54 pivotally moves in the direction illustrated by arrow 82, and returns to its original or "unloaded" position, thereby shifting the center of gravity 142 to its original location and substantially leveling the fixture 14.

It should be appreciated that by adjusting the force required to compress spring 90 (e.g., by adjusting the spring constant "k" of spring 90) the center of gravity 142 of fixture 14 can be made to shift by different amounts and to different locations, thereby allowing hoist assembly 10 to be relatively easily adapted to lift different types of objects and devices having different centers of gravity. Additionally, spanning member 22 may be adjustably moved, and/or additional weighted members 118 may be selectively attached to and/or removed from portion 116 of rod 60, in order to change or alter the center of gravity of fixture 14, thereby accommodating different types of objects and devices.

It should be understood that this invention is not limited to the exact construction or embodiments listed and described but that various changes may be made without departing from the spirit and scope of the invention.

What is claimed is:

1. A hoist assembly for lifting an object, said hoist assembly comprising:

a plurality of interconnecting members which are selectively coupled to said object; and a fixture which is coupled to said interconnecting members and which includes a movable member from which said fixture is selectively suspended and a center of gravity, said center of gravity being located in a first location which allows said fixture to be suspended in a substantially level position when said object is disconnected from said fixture, said movable member being automatically and pivotably movable without operator assistance from a first position to a second position in response to said object being lifted, said movement being effective to cause said center of gravity to shift to a second location, said shift being effective to cause said fixture and said object to remain level while said object is being lifted.

2. The hoist assembly of claim 1 wherein said fixture is generally triangular in shape.

3. The hoist assembly of claim 2 wherein said fixture comprises three elongated members.

4. The hoist assembly of claim 3 wherein said three elongated members are interconnected by three plate members.

5. The hoist assembly of claim 4 wherein said plurality of interconnecting members comprise three chains, each of said three chains being coupled to a unique one of said plate members.

6. The hoist assembly of claim 1 further comprising a selectively compressible spring which is coupled to said movable member, said spring being compressed when said movable member moves from said first position to said second position.

7. The hoist assembly of claim 1 wherein said movable member comprises a generally "L"-shaped arm member.

8. The hoist assembly of claim 1 further comprising a spanning member which is removably mounted upon said fixture, and on which said movable member is pivotally disposed.

9. The assembly of claim 1 wherein said object has a center of gravity which is disposed in a third location and wherein said second location is substantially aligned with said third location.

10. A hoist for lifting an object having a first center of gravity, said hoist comprising:

a force providing member which selectively provides an upward lifting force;

a generally triangular support member having a second center of gravity;

a plurality of interconnecting assemblies, which selectively couple said support member to said object; and a movable lever assembly which is fixedly coupled to said triangular support member, and which is selectively coupled to said force providing member, said movable lever assembly is movable from a first position to a second position when said object is lifted, said movement being effective to cause said second center of gravity to be substantially aligned with said force providing member when said movable lever assembly is in said first position, thereby allowing said support member to be suspended in a substantially level position, and to cause said second center of gravity to be aligned with said first center of gravity when said movable lever assembly is in said second position, thereby ensuring that said object remains level while said object is being lifted.

11. The hoist of claim 10 wherein said generally triangular support member comprises three interconnected elongated rail members.

12. The hoist of claim 10 further comprising a spanning member on which said movable member is disposed, said spanning member being selectively and removably attachable to said support member in a plurality of positions.

13. The hoist of claim 12 further comprising a selectively compressible spring member which is operatively coupled to said movable lever assembly and to said spanning member, said spring member being compressed when said movable lever assembly is moved from said first to said second position.

14. The hoist of claim 10 wherein said movable lever assembly comprises a generally "L"-shaped lever.

15. A method for lifting an object, said method comprising the steps of:

providing a fixture having a movable member and a center of gravity;

suspending said fixture from a point on said movable member which is substantially aligned with said center of gravity, thereby causing said fixture to remain in a substantially level position while said fixture is suspended;

providing at least one linking member;

coupling said at least one linking member to said fixture;

coupling said at least one linking member to said object, thereby connecting said object to said fixture;

providing an upward force at said point, effective to lift said object, and to cause said movable member to move, thereby shifting said center of gravity and causing said object and said fixture to remain in a level position;

wherein said fixture comprises three elongated and interconnected rail members; and wherein said at least one linking member comprises three separate linking members.

16. The method of claim 15 wherein said three linking members each comprises a latch.

17. The method of claim 16 wherein each of said three linking members is coupled to said object by way of said latches and three eyebolts which are connected to said object.

* * * * *

UNITED STATES PATENT AND TRADEMARK OFFICE

CERTIFICATE OF CORRECTION

PATENT NO. : 6,357,810 B1
DATED : March 19, 2002
INVENTOR(S) : Kyle E. Schwulst

It is certified that error appears in the above-identified patent and that said Letters Patent is hereby corrected as shown below:

Title page,
Item [73], replace "Ford Global Technologies, Inc" with -- Visteon Global technologes, Inc. --.

Signed and Sealed this

Twenty-first Day of January, 2003

JAMES E. ROGAN
*Director of the United States Patent and Trademark Office*